US005848736A

United States Patent [19]

Boumann

[11] Patent Number: 5,848,736

[45] Date of Patent: Dec. 15, 1998

[54] BEVERAGE DISPENSER

[76] Inventor: Pete A. Boumann, 1619 W. Crescent, Apt. S-102, Anaheim, Calif. 92801

[21] Appl. No.: 857,995

[22] Filed: May 16, 1997

[51] Int. Cl.[6] ..... B67D 3/00

[52] U.S. Cl. ..... 222/185.1; 222/481.5

[58] Field of Search ..... 222/180, 181.1, 222/181.3, 185.1, 481.5, 482, 484

[56] References Cited

U.S. PATENT DOCUMENTS

| | | | |
|---|---|---|---|
| 3,042,267 | 7/1962 | Reynard | 222/185 |
| 3,139,219 | 6/1964 | Gran | 222/129.1 |
| 3,933,275 | 1/1976 | Metzner et al. | 222/131 |
| 4,143,795 | 3/1979 | Casebier | 222/143 |
| 4,260,078 | 4/1981 | Kaphart | 222/184 |
| 4,646,944 | 3/1987 | Sanderson | 222/108 |
| 4,664,297 | 5/1987 | Giovinazzi | 222/185 |
| 4,715,516 | 12/1987 | Salvail | 222/153 |
| 4,722,463 | 2/1988 | Anderson | 222/185 |
| 4,844,290 | 7/1989 | McCurdy et al. | 222/185 |
| 4,911,334 | 3/1990 | Kedzierski | 222/185 |
| 4,928,855 | 5/1990 | Ramsey | 222/131 |
| 5,024,353 | 6/1991 | Horne | 222/185 |
| 5,104,003 | 4/1992 | Stecoza | 222/83.5 |
| 5,335,829 | 8/1994 | Sovann | 222/183 |
| 5,564,597 | 10/1996 | Koorse et al. | 221/96 |
| 5,577,638 | 11/1996 | Takagawa | 222/185.1 |

*Primary Examiner*—Kevin P. Shaver

*Attorney, Agent, or Firm*—Gene Scott-Patent Law & Venture Group

[57] ABSTRACT

A beverage dispensing apparatus provides a receiver for accepting an inverted beverage bottle. The bottle is capped by a screw-on top having a conical dispensing neck. The dispensing neck is normally plugged by a stopper that is urged into the neck by a spring. When the bottle is inverted, therefore, the beverage is not able to flow out of the neck. When the bottle is inserted into the receiver, the side wall of the screw-on top is sealed within an o-ring held in the receiver. Also, the stopper is forces away from contact with the dispensing neck by a positioning surface within the receiver so that beverage is able to flow from the container into the receiver. The stopper also makes contact with an air tube which protrudes upwardly within the receiver. A bore within the stopper receives the air tube and provides a conduit to a further tube which delivers the air to the bottom of the container which therefore allows air to replace the beverage leaving the container.

6 Claims, 4 Drawing Sheets

BEVERAGE DISPENSER

The present invention is a substitute application for previously filed utility application Ser. No. 08/668,687 filed on Jun. 24, 1996.

BACKGROUND OF THE INVENTION

1. Field of the Invention

This invention relates generally to beverage dispensers, and more particularly to a beverage dispensing apparatus for accepting a beverage container in the inverted orientation without spilling the beverage, and for dispensing the beverage.

2. Description of Related Art

The following art defines the present state of this field:

Reynard, U.S. Pat. No. 3,042,267 describes a liquid dispensing device. This device provides support that may be readily attached to the outlet or neck end of a bottle or jug while the bottle is in an upright position. After which the support and bottle as a unit may be placed on a refrigerator shelf or other mounting in an inverted position from which the milk may be conveniently released be an improved control as needed without removing the bottle from the shelf until its contents are gone.

Gran, U.S. Pat. No. 3,139,219 describes a milk dispenser for cooled liquid comestibles that is simple, inexpensive and efficient, and which lends itself to integration with existing modes of distribution. It provides a dispenser for milk that avoids utilizing milk containers that must be punctured, and provides, instead, milk containers that may be used with existing dairy equipment, and further provides milk discharging devices that have a long life and are easy to clean.

Metzner et al., U.S. Pat. No. 3,933,275 describes a portable beverage dispenser having a housing that contains a casing provided with a plurality of bottle receptacles for the purpose of holding bottles of beverage in an inverted position. Beverages flow from the bottle to individual cooling cups, which are disposed within an ice compartment, and from the cooling cups through pipes to individual spigots mounted on the outside of the housing. A hinged panel is provided on the casing to prevent accidental spilling of the beverage into the ice compartment when the bottles are installed in the housing. The housing has the overall configuration of a wooden barrel and is mounted on a wheeled chassis.

Casebier, U.S. Pat No. 4,143,795 describes new refrigerator beverage dispensers that comprise multiple containers fitted in a rack that can rest on the shelf of a refrigerator. The front of each container is concave to accommodate a cup or like receptacle for filling from a dispenser spout that extends forward from the bottom of the container front. The containers may be removed from the rack by sliding forward when a retaining gate hinged to the front of the rack is lowered or the rack and containers may be removed as a unit from the refrigerators. Several embodiments of filler cups for the containers are disclosed to allow the containers to be easily filled or cleaned.

Kephart, U.S. Pat. No. 4,260,078 relates to drink dispensers and particularly to an attachment that may be placed in an inverted position on a shelf and the contents dispensed as needed. The attachment comprises a tubular member having the same contour as the bottle but slightly larger and adapted to fit over the bottle and to form a base for the bottle when the bottle and attachment are inverted. A partition within the attachment contains a closure for the bottle, so that the closure will take the place of the original cap. The attachment closure has two flexible tubes extending through it.

Sanderson, U.S. Pat No. 4,646,944 describes a liquid dispensing apparatus that is provided for use in combination with rigid or semi-rigid inverted liquid containers. The liquid dispensing apparatus is comprised of a base portion that provides a stable platform for the combination, a coupling extending up from the base portion that is inserted in to the neck of the open liquid container to provide a seal around the neck of the open liquid container. This provides a seal around the neck to provide an opening to discharge the liquid and a spigot with a valve in communication with the opening to control the flow of liquid.

Giovinazzi, U.S. Pat No. 4,664,297 describes a beverage dispenser particularly for home refrigerators and includes a one-piece cradle that can support one or more large beverage bottles in an inclined mode to promote gravity discharge of the beverage. A dispensing valve can be directly coupled with the threaded necks of larger sized bottles and with a threaded adapter can be coupled with the neck of a smaller size bottle.

Salvail, U.S. Pat. No. 4,715,516 describes an apparatus for dispensing carbonated beverages and the like from a container that has a body portion adapted to replace a screw top cap of the container. The body portion includes a tube, which will project into the ullage volume of the container and will vent to the atmosphere via a normally closed vent valve. A normally closed fluid valve is disposed in the body portion between a fluid chamber and a spout.

Anderson, U.S. Pat. No. 4,722,463 describes an apparatus for dispensing fluids from a bottle comprising of a housing having a bore extending through the housing and a connector for releasable securing the housing the mouth of a bottle containing fluid. A spool received within the bore of the housing is selectively positioned in a first, closed position and in a second, open position. The spool is provided with passageways for passage of air and the housing is provided with an inlet port, spout, and an annular groove for passage of fluids.

McCurdy et al., U.S. Pat. No. 4,844,290 describes an apparatus for dispensing fluids from a bottle comprising a housing having a bore extending through the housing and means for releasable securing the housing the mouth of a bottle containing a fluid therein. A spool received within the bore is selectively positioned in a first, closed position and second, open position. A support stand having a vertical support member for supporting the bottle at an angle with respect to the horizontal is also provided. The support stand is provided with a tang having a channel therein for receiving a keel on the housing of the fluid dispensing apparatus to prevent movement between the support stand and bottle.

Kedzierski, U.S. Pat. No. 4,911,334 describes a beverage dispenser for dispensing carbonated beverages from bottled beverages. The dispenser comprises a bottle holder for holding bottles in an inverted position and a dispensing valve which screws onto each bottleneck in place of its standard cap closure. The dispensing valve has two passages: a vent passage to decompress the beverage in the bottle just before its discharging of the beverage and the second a discharging passage for the discharging of beverage therefrom.

Ramsey, U.S. Pat. No. 4,928,855 describes for one or more large size carbonated beverage bottles. The dispenser apparatus comprises a supporting base having a top surface with one or more vertical opening each configured to receive and hermetically seal the open end of a large size carbonated beverage bottle in an inverted position and a horizontal from opening for each vertical opening.

Home, U.S. Pat. No. 5,024,353 describes a dispenser mechanism attachable to a plastic soft drink bottle to permit measured liquid quantities to be dispensed from the bottle. A cradle type support is provided for positioning the bottle in an inverted tilted condition within a refrigerator. Liquid can be dispensed from the bottle without removing the bottle from the refrigerator.

Stecoza, U.S. Pat. No. 5,104,003 describes a carbonated dispensing apparatus that includes a housing to mount a beverage container therewith, with the housing including a piercing tube for projecting directly through a lid of a carbonated beverage container that is mounted in an inverted orientation relative to the housing.

Sovann, U.S. Pat. No. 5,335,829 describes a portable beverage dispenser for use with two liter beverage bottles. The dispenser supports bottle in an inverted position and is suited to be placed on a horizontal surface for outdoor use. Pluralities of independent cap units are located on each bottle. A support cabinet is provided for housing the bottles during use.

Koorse et al., U.S. Pat. No. 5,564,597 describes a portable container beverage dispensing system. The beverage dispenser uses the original beverage container that is inverted and loaded into a sleeve inside the beverage dispensing system. A conduit is attached to the beverage container that is in turn attached to a spigot which is accessible from the outside of the portable container. The beverage is gravity fed to the spigot. The beverage container is insulated from external temperature problems, and is held in close proximity to thermal control devices to provide more efficient beverage temperature control. The sleeve may alternatively be used as a reservoir, for an optional cup dispenser or for an optional storage container.

Takagawa, U.S. Pat. No. 5,577,638 describes a bottom pouring pot comprising a cartridge for accommodating liquid, and a separate mounting base for detachably mounting the cartridge thereto. An inner container having an opening at a lower end thereof is placed in the cartridge, the opening being closed with a detachable plug body. A discharge port for discharging the liquid being formed in the plug body and is closed with first opening means for opening the discharge port when the cartridge is mounted on the base.

The prior art teaches several beverage dispensing apparatus as described above. However, the prior art does not teach a dispenser capable of accepting an inverted beverage container in sealed engagement, and providing a means for defeating a stopper while interconnecting an air inlet pipe for replacing the beverage with air as the beverage is drawn out of the container. The present invention fulfills these needs and provides further related advantages as described in the following summary.

SUMMARY OF THE INVENTION

The present invention teaches certain benefits in construction and use which give rise to the objectives described below.

A beverage dispensing apparatus provides a receiver for accepting an inverted beverage bottle. The bottle is capped by a screw-on top having a conical dispensing neck. The dispensing neck is normally plugged by a stopper that is urged into the neck by a spring. When the bottle is inverted, therefore, the beverage is not able to flow out of the neck. When the bottle is inserted into the receiver, the side wall of the screw-on top is sealed within an o-ring held in the receiver. Also, the stopper is forced away from contact with the dispensing neck by a positioning surface within the receiver so that beverage is able to flow from the container into the receiver. The stopper also makes contact with an air tube which protrudes upwardly within the receiver. A bore within the stopper receives the air tube and provides a conduit to a further tube which delivers the air to the bottom of the container which therefore allows air to replace the beverage leaving the container.

A primary objective of the present invention is to provide a beverage dispensing apparatus having advantages not taught by the prior art.

Another objective is to enable a gravity feed beverage dispenser for providing beverage outflow from the container while replacing the liquid with air.

A further objective is to provide such a dispenser capable of receiving and rejecting filled beverage containers without the possibility of spillage.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
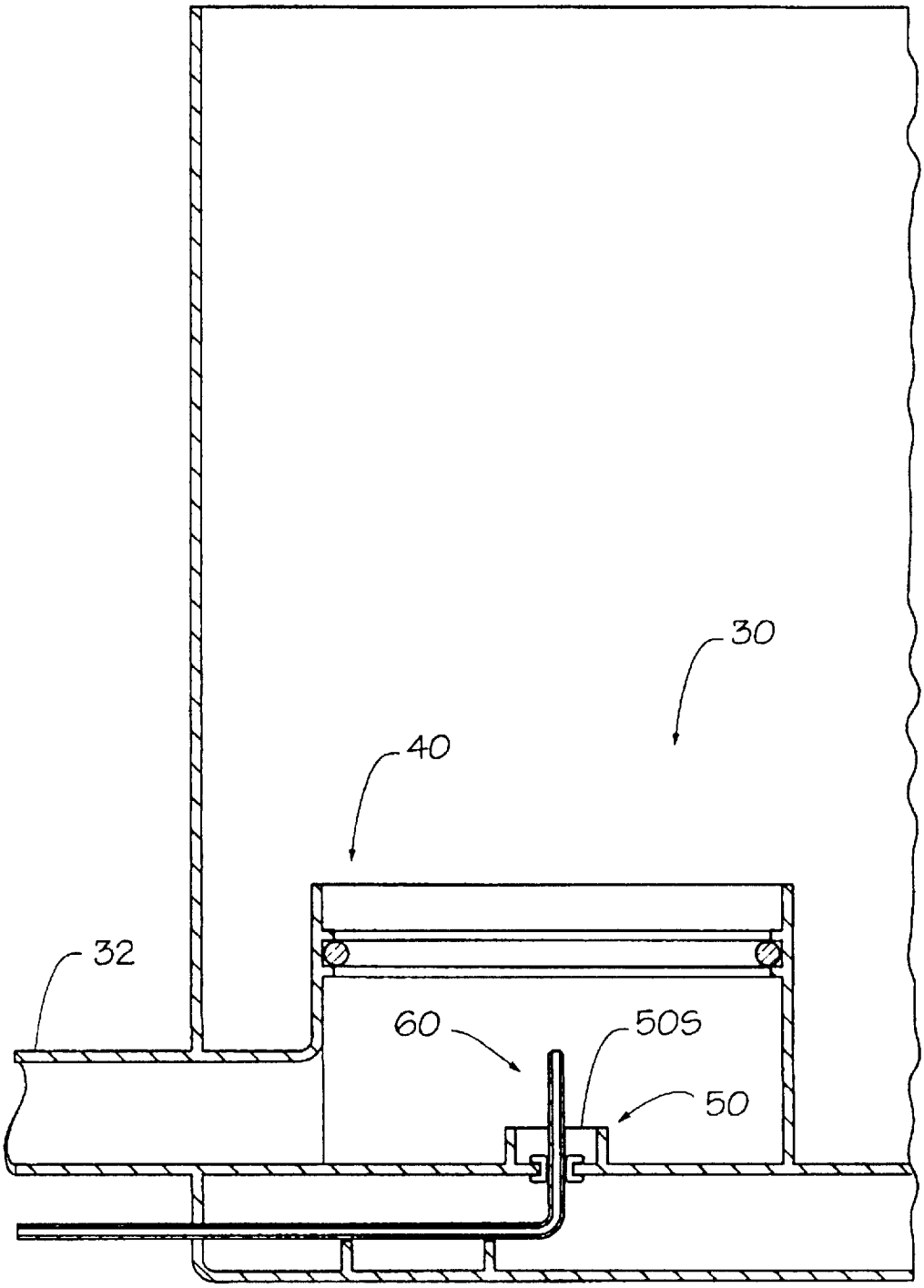
FIG. 1 is a front elevational view of a beverage receiver portion of the preferred embodiment of the present invention.
Figure 2:
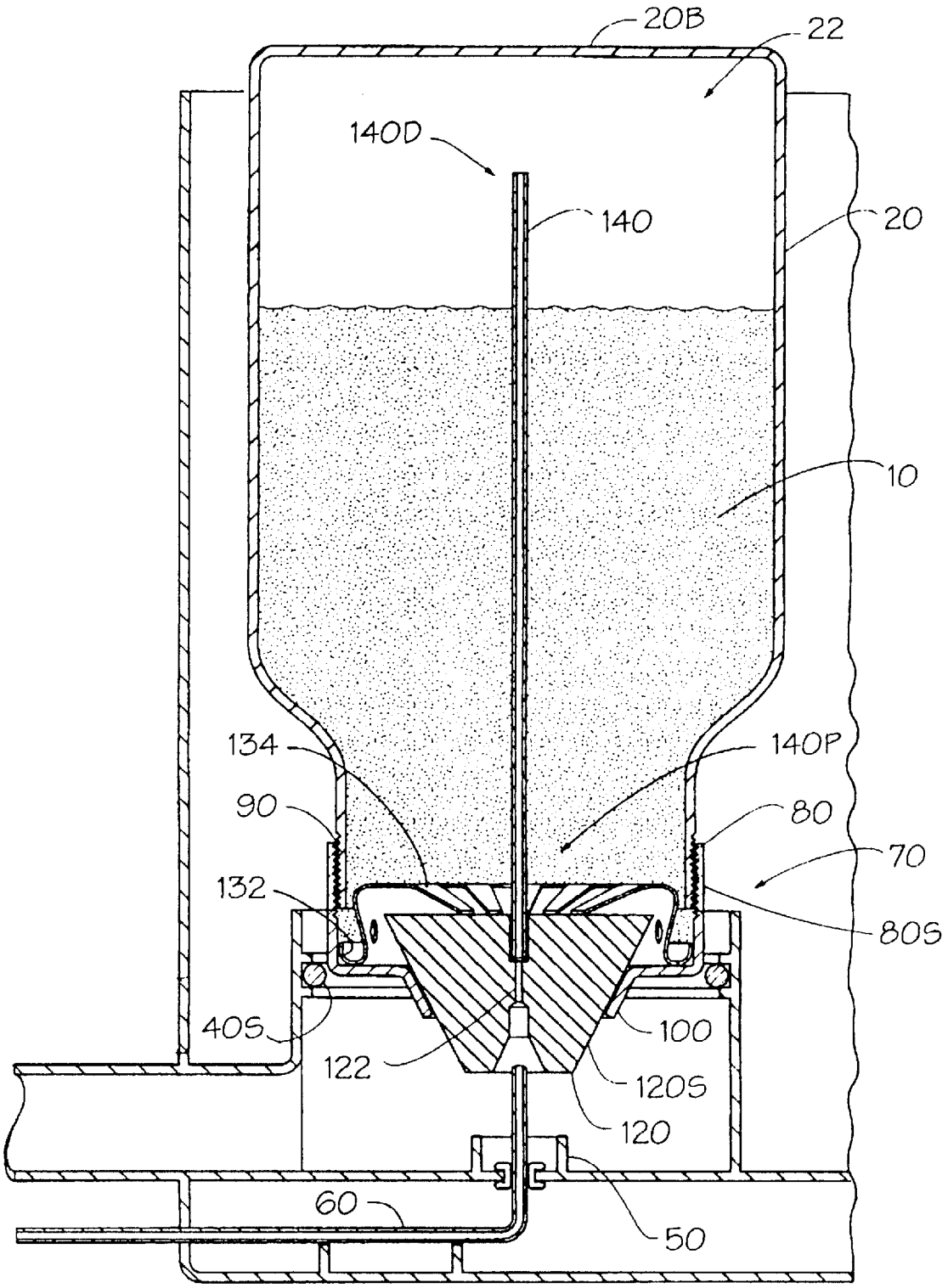
FIG. 2 is a front elevational view thereof further showing a closure assembly portion of the invention as mounted on a beverage container shown in the process of being installed into the receiver portion.
Figure 3:
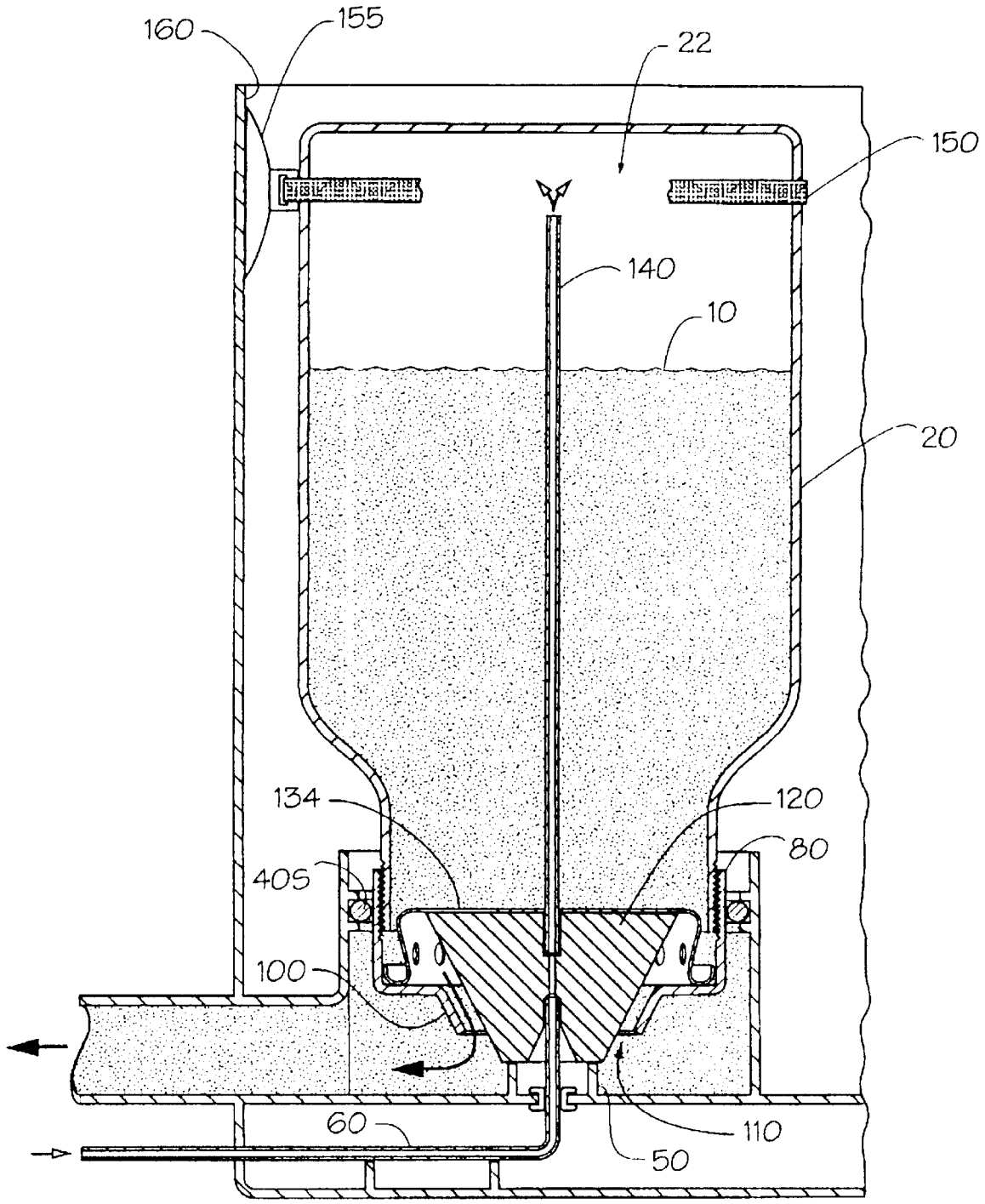
FIG. 3 is a front elevational view thereof with the beverage container shown fully inserted into the receiver portion.

The above described drawing figures illustrate the invention, an apparatus for dispensing a beverage 10, such as soda, lemonaide and such, stored within a beverage container 20, such as a standard two liter bottle, while the container is supported in the inverted position as shown in FIG. 3. The apparatus comprises a beverage receiving compartment 30 as best shown in FIG. 1, which provides a sealing means 40 such as a rubber o-ring, a stopper positioning means 50 extending upwardly within the receiving compartment 30, and an air inlet means 60 such as a tube positioned as shown so that air can be drawn from outside the compartment 30 and be delivered to the upwardly extending tip of the tube.

A closure assembly 70 provides a capping means 80 having a leak proof engagement means 90, preferably a screw thread, for engaging the beverage container 20 for mounting the capping means 80 on the container 20 much like any conventional screw-on cap for a food or beverage container. A conical dispensing neck 100 forms a dispensing aperture 110 for delivery of the beverage 10 from the container 20. The capping means 80 preferably provides an annular smooth outer wall surface 80S. The sealing means 40 of the receiving compartment 30 includes an annular resilient surface 40S which provides sealing contact with the annular smooth outer wall 80S of the capping means 80 for sliding sealing contact between them as the beverage container is pressed into the receiver 30.

Figure 4:
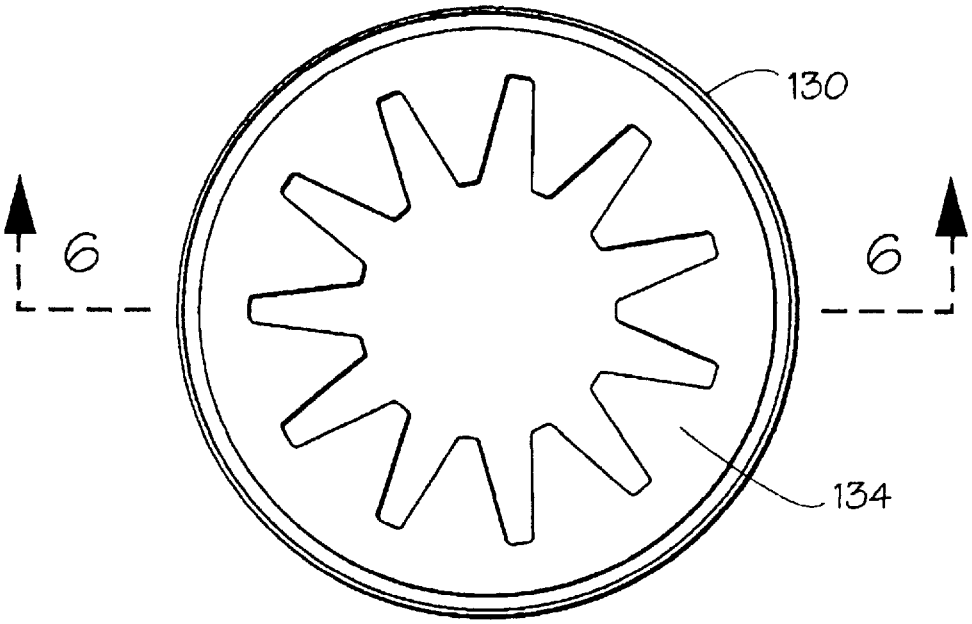
FIG. 4 is a top plan view of a stopper position urging means thereof.
Figure 5:
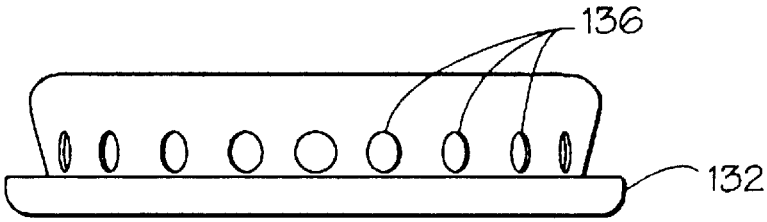
FIG. 5 is a side elevational view of the urging means.
Figure 6:
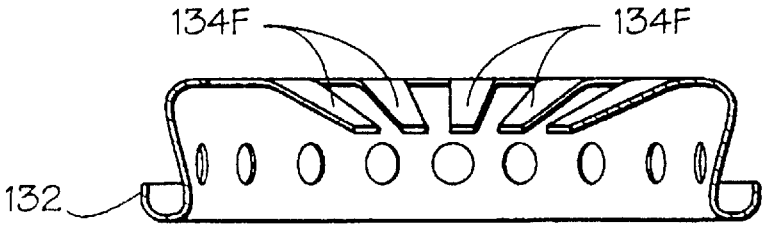
FIG. 6 is a sectional view taken along cutting line 6—6 in FIG. 4.

A stopper means 120 having a conical sidewall surface 120S is movable into sealing contact with the conical dispensing neck 100 of the capping means 80. Therefore, when the beverage container 20 is inverted, the weight of the beverage 10 presses the stopper means 120 against the dispensing neck 100 to seal the aperture 110. The stopper means 120 provides a through bore 122. A stopper position urging means 130, as shown in FIGS. 4–6 is made of a spring material, such as spring steel or beryllium copper, and provides a first spring contact means 132 engaged with the capping means 80 for securing the urging means 130 within the capping means 80. To seat the urging means 130 within the capping means 80, the first contact means 132 flexes inwardly to accommodate the interior diameter of the capping means 80, and once seated, the first contact means 132 flexes back toward its natural position (shown in FIG. 6), thereby exerting an outward hoop stress on the capping means 80 in order to hold the first contact means 132 within the capping means 80. A series of circularly arranged fingers 134F comprise a second spring contact means 134 which biases the conical sidewall 120S of the stopper means 120 against the conical neck 100 of the capping means 80 for sealing the dispensing aperture 110. Therefore, unless the stopper means is pressed into the container 20, it is normally pressed into contact with the conical neck 100 for sealing the container 20. The second spring contact means 134 is vertically movable for establishing a spaced relationship between the conical sidewall 120S of the stopper means 120 and the conical neck 100 of the capping means 80 so as to dispense the beverage 10 through the dispensing aperture 110 when the container 20 is inverted. A series of holes 136 enable the beverage 10 to more freely pass through the urging means 130. A conduit means 140, preferably a tube, is engaged at a proximal end 140P with the stopper bore 122 and is held in position, preferably along the vertical axis of the container 20, by the stopper bore 122, while a distal end 140D extends in proximity with a bottom wall 20B of the beverage container 20. The outer wall surface 80S of the capping means 80 is engaged with the annular resilient surface 40S of the container sealing means 40 for sealing the receiving compartment 30 with the closure assembly 70, as best illustrated in FIG. 3.

The stopper positioning means 50 preferably provides an annular surface 50S extending upwardly within the receiving compartment 30 and positioned for contact with the stopper means 120, the air inlet means 60 providing a tubular conduit extending upwardly within the annular surface 50S of the stopper positioning means 50 and terminating above the annular surface 50S. The stopper means 120 is brought into contact with the stopper positioning means 50 as the beverage container 20 is moved downwardly into the receiving compartment 30, the air inlet means 60 engaging the stopper bore 122 for enabling fluid (air) communication between the air inlet means 60 and the conduit means 140 for delivering air to the bottom of the container 22. The stopper means 120 is supported between the stopper positioning means 50, on one side, and the stopper position urging means 130, on the other side, for maintaining the dispensing aperture 110 in the open state for fluid flow. Whereby the beverage 10 flows from the beverage container 20, through the dispensing aperture 110 and into the receiving compartment 30 for dispensing the beverage 10 through a dispensing pipeline 32 in fluid communication with the receiving compartment 30, while simultaneously, air is introduced through the air inlet means 60, the stopper bore 122, and into the beverage container 20 through the conduit means 140 as urged by suction in the beverage container 20 due to the out-flowing beverage 10. A supporting means 150 comprising a strap encircles the bottle 20 and includes an attachment means 155 for connecting the strap to any surrounding supporting wall 160, such as the wall of a refrigerator. Therefore the bottle 20 is further held in a preferred inverted attitude for dispensing the beverage 10 by gravity flow within the receiver 30. The dispensing pipeline 32 and the air inlet means 60 are preferably in fluid interconnection with a dispensing valve and an air inlet valve respectively. Such valves and valve interconnections are of very well known types in the art so that details of such are not shown in the present description or drawings. It is clear that when a dispensing valve draws the beverage from the receiver 30, and at the same time an air inlet valve is opened for allowing air to enter air inlet means 60, the beverage within the container is drawn down by gravity force while air flows into the container to replace the beverage volume that has been drawn off. When the beverage 10 has been removed from the container, the container may be removed from the receiver by simply pulling it upwardly. Any beverage 10 remaining within the receiver 30 may then be removed through the dispensing valve by gravity flow. It is clear that the container 20 may be removed from the receiver 30 at any time, even when the container 20 is filled with the beverage 10, without spilling the beverage 10. The dispensing aperture 110 is closed as the container 20 is drawn upwardly because the stopper position urging means 130 forces the stopper means 120 against the neck 100 as soon as the stopper means 120 is pulled away from the annular surface 50S, and this occurs before the outer wall surface 80S losses contact with the annular resilient surface 40S.

The closure assembly 70 may be unscrewed from the container 20 and placed upon a new container 20 which may then be inverted and inserted into the invention to continue beverage dispensing operations. It is clear that multiple receivers 30 may be used with multiple beverage containers 20 each having a closure assembly 70 attached in a multiple beverage dispensing apparatus.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for dispensing a beverage stored within a beverage container, the apparatus comprising:

a beverage receiving compartment providing a sealing means, a stopper positioning means, and an air inlet means;

a closure assembly providing:

a capping means having a leak proof engagement means engaging the beverage container for mounting the cap on the container, and a conical dispensing neck forming a dispensing aperture;

a stopper means having a conical sidewall surface movable into sealing contact with the conical dispensing neck of the capping means, the stopper means providing a bore therethrough;

a stopper position urging means made of a spring material, the urging means providing a first spring contact means engaged with the capping means and securing the urging means within the capping means, and integral therewith, a second spring contact means biasing the conical sidewall surface of the stopper means against the conical neck of the capping means for sealing the dispensing aperture, the second spring contact means being movable for establishing a spaced relationship between the conical sidewall surface of the stopper means and the conical neck of the capping means for dispensing the beverage through the dispensing aperture;

a conduit means engaged at a proximal end thereof with the stopper bore, a distal end thereof extending in proximity with a bottom wall of the beverage container; the capping means being engaged with the container sealing means for sealing the receiving compartment with the closure assembly, the stopper positioning means moving into contact with the stopper as the beverage container is moved downwardly into the receiving compartment, the air inlet means engaging the stopper bore for enabling fluid communication between the air inlet means and the conduit means for delivering air to the bottom of the container, the stopper means being supported between the stopper positioning means and the stopper position urging means for maintaining the dispensing aperture;

whereby the beverage flows from the beverage container, through the dispensing aperture and into the receiving compartment for dispensing the beverage through a dispensing pipeline in fluid communication with the receiving compartment, while air is introduced through the air inlet means, through the stopper bore, and into the beverage container through the tube as urged by suction in the beverage container due to the outflowing beverage.

2. The apparatus of claim 1 wherein the capping means provides an annular smooth outer wall surface, and the sealing means of the receiving compartment includes an annular resilient surface in sealing contact with the annular smooth outer wall surface of the capping means for sealing contact therebetween.

3. The apparatus of claim 1 wherein the stopper positioning means provides an annular surface extending upwardly within the receiving compartment and positioned for contact with the stopper means, the air inlet means providing a tubular conduit extending upwardly within the annular surface of the stopper positioning means and terminating above the annular surface.

4. The apparatus of claim 1 wherein the engagement means of the capping means is a screw thread.

5. The apparatus of claim 1 wherein the conduit means is a tube.

6. The apparatus of claim 1 further including a supporting means comprising a strap encircling the bottle and including an attachment means connecting the strap to a supporting wall.

* * * * *